US010638824B2

(12) United States Patent
Perl et al.

(10) Patent No.: US 10,638,824 B2
(45) Date of Patent: May 5, 2020

(54) COSMETICS CARRY SYSTEM

(71) Applicants: Lawrence Perl, Aventura, FL (US); Harriet Hoffman, Avon, CT (US)

(72) Inventors: Lawrence Perl, Aventura, FL (US); Harriet Hoffman, Avon, CT (US)

( * ) Notice: Subject to any disclaimer, the term of this patent is extended or adjusted under 35 U.S.C. 154(b) by 0 days.

(21) Appl. No.: 15/951,456

(22) Filed: Apr. 12, 2018

(65) Prior Publication Data

US 2019/0313766 A1 Oct. 17, 2019

(51) Int. Cl.

| | |
|---|---|
| ***A45D 34/00*** | (2006.01) |
| ***A45D 34/04*** | (2006.01) |
| *A45D 29/12* | (2006.01) |

(52) U.S. Cl.

CPC ..... *A45D 34/00* (2013.01); *A45D 34/045* (2013.01); *A45D 29/12* (2013.01); *A45D 2200/25* (2013.01)

(58) Field of Classification Search

CPC ..... A45D 2040/0018; A45D 34/06; A45D 34/00; A45D 34/045; A45D 40/18; A45D 40/24; A45D 40/265; A45D 2200/25; A45D 29/12

See application file for complete search history.

(56) References Cited

U.S. PATENT DOCUMENTS 2,665,696 A 1/1954 Weis
2,691,184 A * 10/1954 Miller ..... A45D 34/045 222/425
2,751,914 A * 6/1956 Katz ..... A45D 40/24 132/316
2,796,873 A * 6/1957 Little ..... A45D 40/24 132/318
3,341,884 A * 9/1967 Pryor ..... A45D 34/042 132/74.5
5,897,262 A 4/1999 Bratby-Carey
6,450,179 B2 9/2002 Bengis
6,702,494 B2 3/2004 Dumler et al.
6,709,181 B1 * 3/2004 Montoli ..... A45D 40/265 401/122
6,896,433 B1 5/2005 Zhang et al.
7,168,875 B1 1/2007 Zhang et al.
7,175,359 B2 2/2007 Zhang et al.
7,424,890 B2 * 9/2008 Noel ..... A45D 40/24 132/218
7,600,936 B2 10/2009 Landow
7,654,762 B2 2/2010 Carlino
7,845,871 B2 12/2010 Thiebaut
8,545,120 B2 10/2013 Breidenbach et al.
8,662,775 B1 3/2014 Liu (Continued)

*Primary Examiner* — Cris L. Rodriguez
*Assistant Examiner* — Brianne E Kalach
(74) *Attorney, Agent, or Firm* — The Concept Law Group, PA; Scott D. Smiley; Scott M. Garrett

(57) ABSTRACT

A cosmetics carry system include a carrier that has an elongate body with openings at the opposite ends of the elongated body. At each end there are retaining features to non-permanently retain a small container of product in each end of the carrier. The containers can include a cap having an applicator that extends into the container. The retaining features are designed to allow the user to change the containers carried in the carrier so that the user can, for example, match color for lip gloss and nail polish. The carrier is a permanent member that can have decorative artwork on the outside, while the containers that are carried in the carrier can be disposable.

6 Claims, 10 Drawing Sheets

(56) References Cited

U.S. PATENT DOCUMENTS

| | | | | |
|---|---|---|---|---|
| 9,004,791 | B2 | 4/2015 | Acierto et al. | |
| 9,332,818 | B2 | 5/2016 | Holloway | |
| D787,835 | S | 5/2017 | Lim | |
| 2004/0202502 | A1* | 10/2004 | Gueret | A45D 34/045 401/129 |
| 2005/0019084 | A1* | 1/2005 | Gueret | A45D 34/06 401/25 |
| 2007/0110502 | A1* | 5/2007 | Salciarini | A45D 40/00 401/131 |
| 2011/0100866 | A1* | 5/2011 | Gueret | A45D 40/265 206/581 |
| 2016/0128445 | A1 | 5/2016 | Lim | |
| 2016/0143417 | A1 | 5/2016 | Eberlein | |
| 2017/0035185 | A1 | 2/2017 | Littlewood | |
| 2017/0105507 | A1* | 4/2017 | Golding | A45D 40/24 |
| 2017/0231378 | A1* | 8/2017 | Godin | A46B 9/021 132/218 |

* cited by examiner

700

COSMETICS CARRY SYSTEM

FIELD OF THE INVENTION

The present invention relates generally to cosmetics containers, and, more particularly, relates to a container system for carrying small amounts of cosmetic substances in a carry case which contains disposable cosmetics cartridges.

BACKGROUND OF THE INVENTION

Cosmetics are in widespread usage and it is common for a person to carry cosmetics products with them in order to touch up or reapply the cosmetics. Some of the more commonly carried cosmetics include lipstick and lip gloss, nail polish, mascara, and eye liner. Typically these are sold individually packaged, but some manufacturers have produced container systems that include two or more types of cosmetics that are carried together. Although these systems are provided in an assortment of combinations of cosmetics, the manufacturer chooses which cosmetics to package together, in either types of cosmetics, or colors, or both. This leaves the customer unable to select a combination they want unless it is one of the combinations provided by the manufacturer. Furthermore, the customer is forced to use the packaging in which the cosmetics are provided, which is designed by the manufacturer, typically for brand recognition. Customers are not able to design their own containers or choose containers with artwork they prefer.

Therefore, a need exists to overcome the problems with the prior art as discussed above.

SUMMARY OF THE INVENTION

The invention provides a cosmetics carry system that overcomes the hereinafore-mentioned disadvantages of the heretofore-known devices and methods of this general type and that allows a user to select and change which cosmetics are carried in a carrier.

With the foregoing and other objects in view, there is provided, in accordance with some embodiments of the invention, a cosmetics carrier system that allows a user to carry different selected ones of cosmetics. The system includes a carrier having an elongated hollow body that has a first end and a second end opposite the first end. A first container retaining feature is formed at the first end, and a second container retaining feature is formed at the second end. The first and second retaining features are configured to mate with corresponding respective retaining features of a first container and a second container, respectively, that are each sized to fit in, and be retained by, the carrier at the first and second ends.

In accordance with another feature, an embodiment of the present invention includes the elongated body of the carrier having a non-circular cross section.

In accordance with a further feature of some embodiments of the present invention, the first and second retaining features comprise threads.

In accordance with a further feature of some embodiments of the present invention, the first and second retaining features comprise interference features.

There is provided, in accordance with some embodiments of the invention, a cosmetics packaging and carry container system that includes a carrier having an elongated body. The elongated body includes a first end and a second end. The first second ends are provided at opposing terminal ends of the elongated body. The carrier can further have a first cavity formed at the first end that extends into the elongated body, and a second cavity formed at the second end that extends into the elongated body. The system can further include a first retention feature at the first end, and a second retention feature at the second end. The system can further include a first container having a body portion that defines an internal volume and that is sized to fit within the first cavity, and which includes a retention feature configured to engage the first retention feature to removably retain the first container in the first cavity. The first container can further include a cap configured to close the internal volume and include an applicator attached to the cap that extends into the internal volume. The system can further include a second container having a body portion that defines an internal volume and that is sized to fit within the second cavity, and which includes a retention feature configured to engage the second retention feature to removably retain the second container in the second cavity. The second container can further include a cap which is configured to close the internal volume and which has an applicator attached to the cap that extends into the internal volume.

In accordance with a further feature of some embodiments of the present invention, the outermost surfaces of the caps of the first and second containers each measure one inch across.

In accordance with a further feature of some embodiments of the present invention, the caps of the first and second containers each include a weight.

In accordance with a further feature of some embodiments of the present invention, the internal volume of the first container and the internal volume of the second container are each limited to 0.24 ounces.

In accordance with a further feature of some embodiments of the present invention, the first retention feature and the second retention feature comprise threads.

Although the invention is illustrated and described herein as embodied in a cosmetics carry system, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
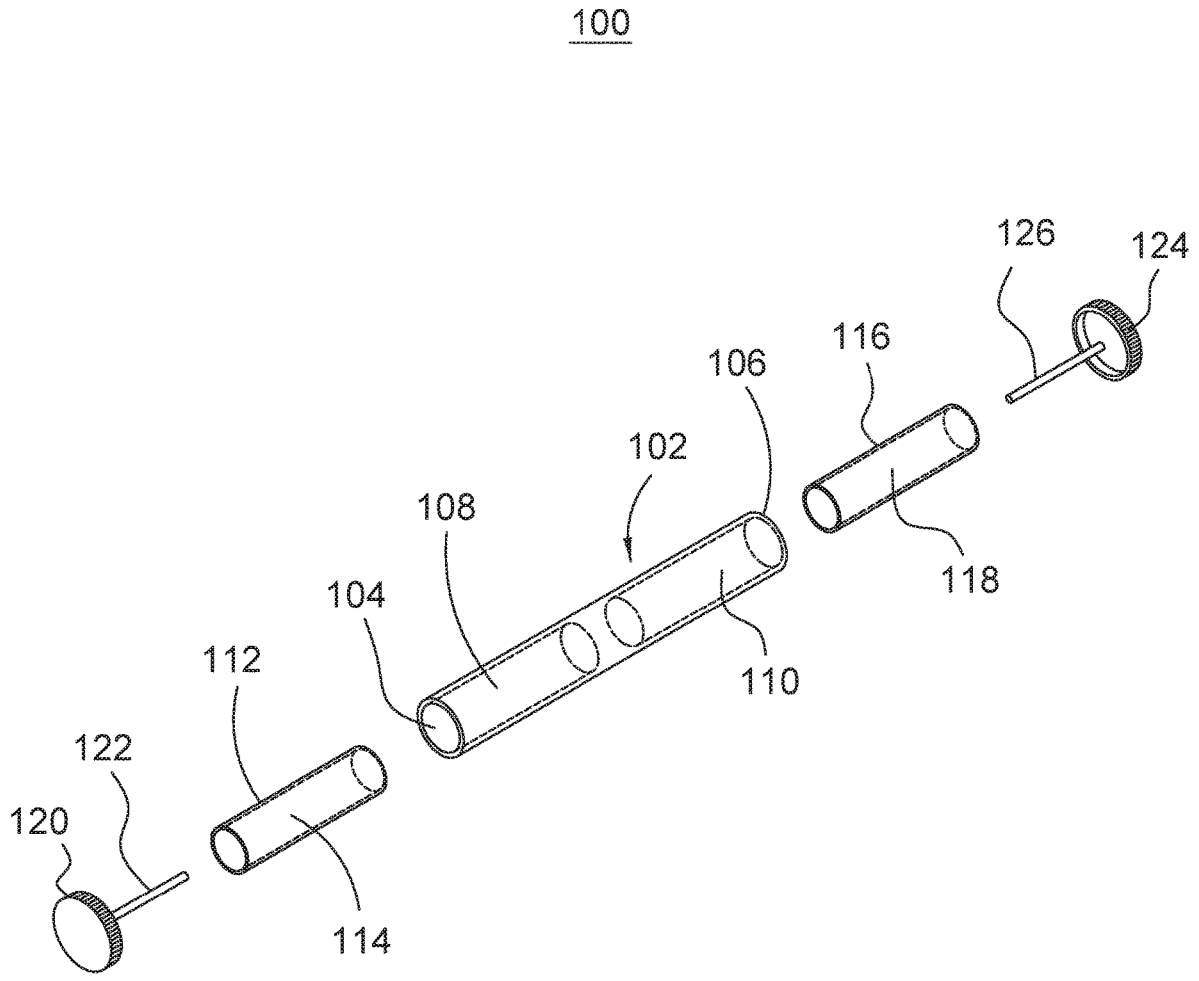
FIG. 1 shows an exploded view of a cosmetics container system for carrying two different cosmetics together, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient cosmetics carrier system that allows a user to carry different selected ones of cosmetics. The system includes a carrier having an elongated hollow body that has a first end and a second end opposite the first end. A first container retaining feature is formed at the first end, and a second container retaining feature is formed at the second end. The first and second retaining features are configured to mate with corresponding respective retaining features of a first container and a second container, respectively, that are each sized to fit in, and be retained by, the carrier at the first and second ends.

Referring now to FIG. 1, there is shown an exploded view of a cosmetics container system 100 for carrying two different cosmetics together, in accordance with some embodiments. The system 100 includes a carrier 102 in which two cartridges or containers can be retained, such as a first container 112 and a second container 116. The carrier 102 can be an elongated structure having openings at opposing ends 104, 106 of the carrier. The openings are contiguous with cavities 108, 110, respectively, inside the carrier. In some embodiments the container may be hollow, rather than defining two separate cavities 108, 110. The first container 112 defines an internal volume 114 in which a cosmetic product or other product (e.g. paint, glue) can be disposed. Likewise, the second container 116 defines a similar internal volume 118. The first container 112 can be closed by a cap 120 which can include an integral applicator 122, and a cap 124 with an applicator 126 can be used to close the second container 116.

The carrier 102 can be designed with artwork on the outside such as images, pictures, sports logos, well known artwork, and so on. In some embodiments the carrier 102 can be provided without any outside design or artwork, allowing the user to create their own such as by painting the exterior of the carrier 102. The carrier 102 is further designed to include retention features that mate with corresponding retention features of the first and second containers 112, 116 to removably retain the containers 112, 116 (or any similarly designed containers) in the carrier 102. The containers 112, 116 are retained such that the caps 120, 124 can be placed on, and removed from the containers 112, 116 while the container 112, 116 are retained within the carrier 102, without the containers 112, 116 coming out of the carrier 102 when the caps 120, 124 are removed. However, the containers 112, 116 are not permanently retained in the carrier 102, and the containers 112, 116 can be removed by the user. Thus, a user can choose which products to carry in the carrier 102, and can choose to change containers 112, 116 for other containers that hold different products, or to replace either container 112, 116 if they become empty. When a containers 112, 116 becomes depleted of the product, the container 112, 116 can be disposed of, replaced, refilled, or filled with a different product.

The caps 120, 124 can include applicators 122, 126, respectively, for applying the cosmetic material, or other material contained in the containers 112, 116. The applicators 122, 126 can include a stem that is terminated by a brush or pad, or any other known cosmetic applicator. The caps 120, 124 can screw onto a threaded portion of the respective containers 112, 116, to close and seal the containers 112, 116 to prevent loss of the material in the containers 112, 116. Furthermore, in some embodiments, the caps 120, 124 can have an outer planar surface that is normal to an axis of the carrier 102 that is sufficient to act as a base on which to stand the system 100 so that the container oriented upwards can be accessed by the user.

Accordingly, the system 100 allows a user to select different cartridges (e.g. containers like containers 112, 116) to be carried in the carrier 102. The user can decide what colors/shades of cosmetic, and what types of cosmetics to place in the carrier 102. This allows the user to keep a variety of containers at home, and select different ones for going to different places, events, or activities. The carrier 102 can be personalized and reusable while the containers 112, 116 can be disposable and replaced.

Figure 2A:
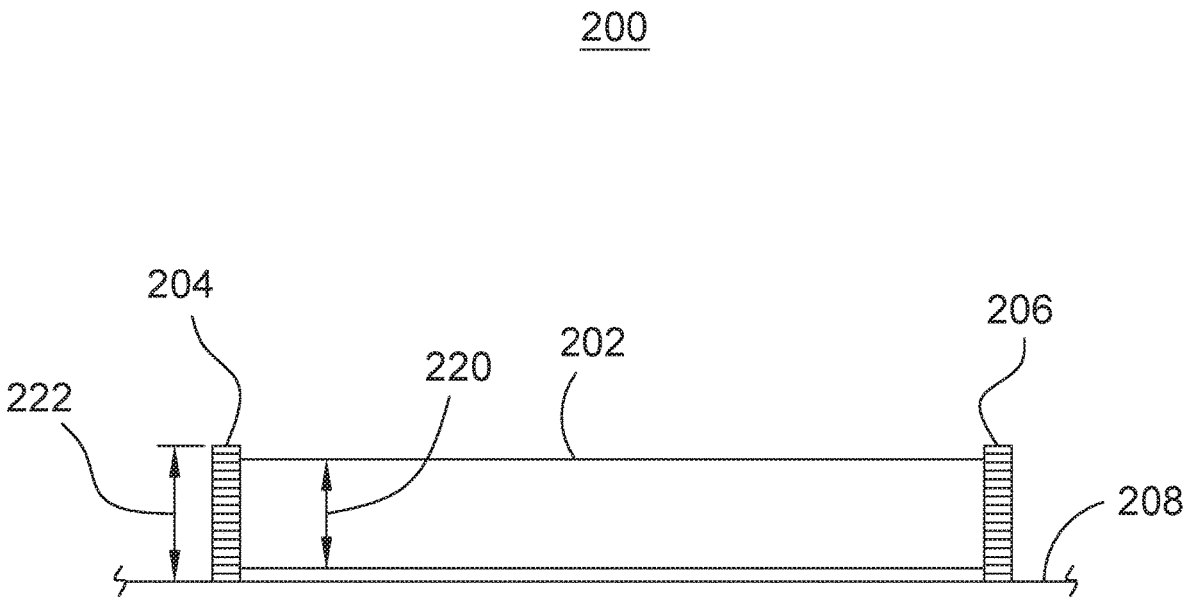
FIG. 2A shows a view of a cosmetics container system on its side on a surface.

FIG. 2A shows a view of a cosmetics container system 200 on its side on a surface 208. In this view the system 200 is assembled. The carrier 202 contains two containers disposed inside it at each of the opposed ends. A first cap 204 and a second cap 206 close off respective containers that are removably retained inside the carrier 202. In some embodiments the carrier 202 can have a circular cross section (i.e. in and out of the page in this view), and have an outer diameter 220 that can be on the order of one half of an inch. The caps 204, 206 can have a diameter 222 that is larger than the diameter 220 of the carrier 202 to allow the system 200 to be stood on one of the caps so that the container at the opposite side can be accessed as in FIG. 2B. In some embodiments the caps 204, 206 can be non-circular to prevent the system from rolling.

Figure 2B:
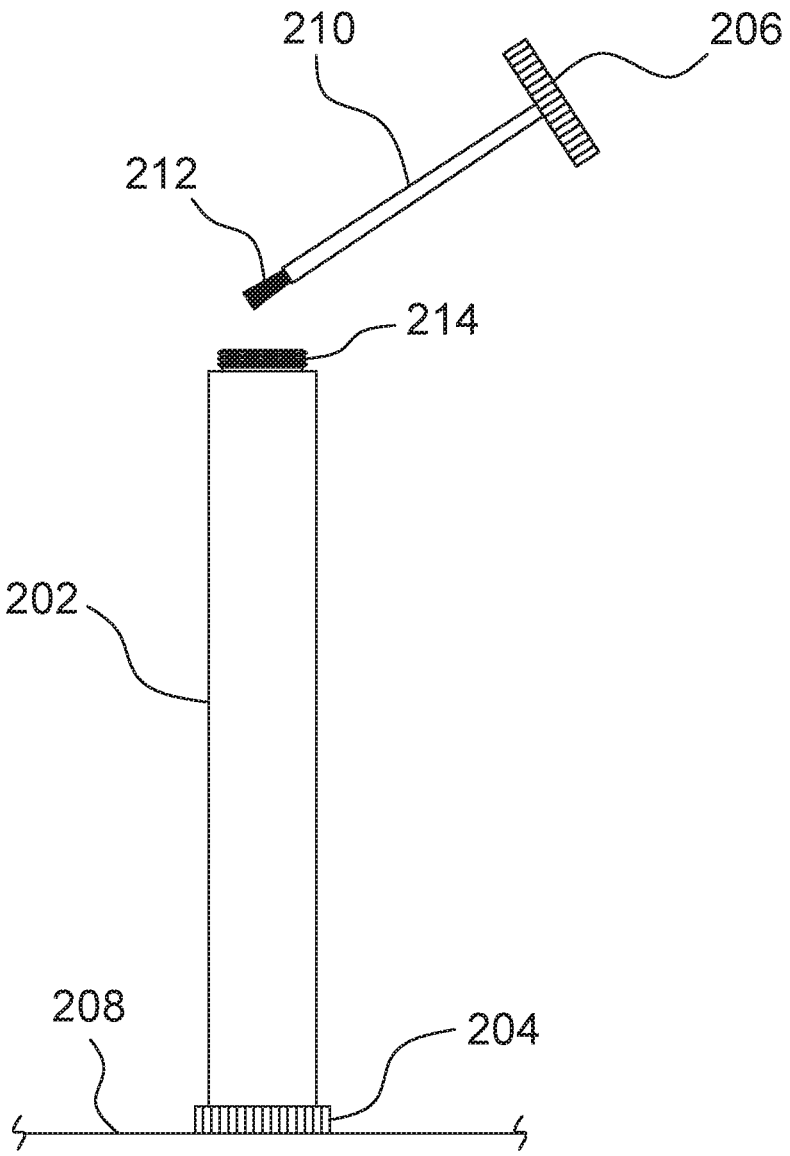
FIG. 2B shows a view of a cosmetics container system standing on an end for applying a cosmetic, in accordance with some embodiments.

FIG. 2B shows a view of a cosmetics container system 200 standing on an end for applying a cosmetic, in accordance with some embodiments. In this orientation the system 200 is standing on cap 204 on the surface 208. Cap 206 can then be removed from its corresponding container 214 such as by unscrewing the cap. The cap 206 can include an applicator including a stem 210 and a brush 212 at the distal end of the stem 210. The container 214 can contain, for example, nail polish, lip gloss, or other such material, which can be applied using the cap 206. If the user wants to access the other container, sealed by cap 204, then cap 206 can be placed back on container 214, closed to seal the container 214, and then the system 200 can be inverted so that cap 206 is resting on surface 208. The caps 204, 206 can have a width or diameter that is sufficient to provide stability when the system is stood on end as shown. In some embodiments, for example, the carrier can have a diameter or width of about one half inch, and a length of about two to three inches, and the caps 204, 206 can have a diameter or width of three quarters of an inch to one inch.

Figure 3:
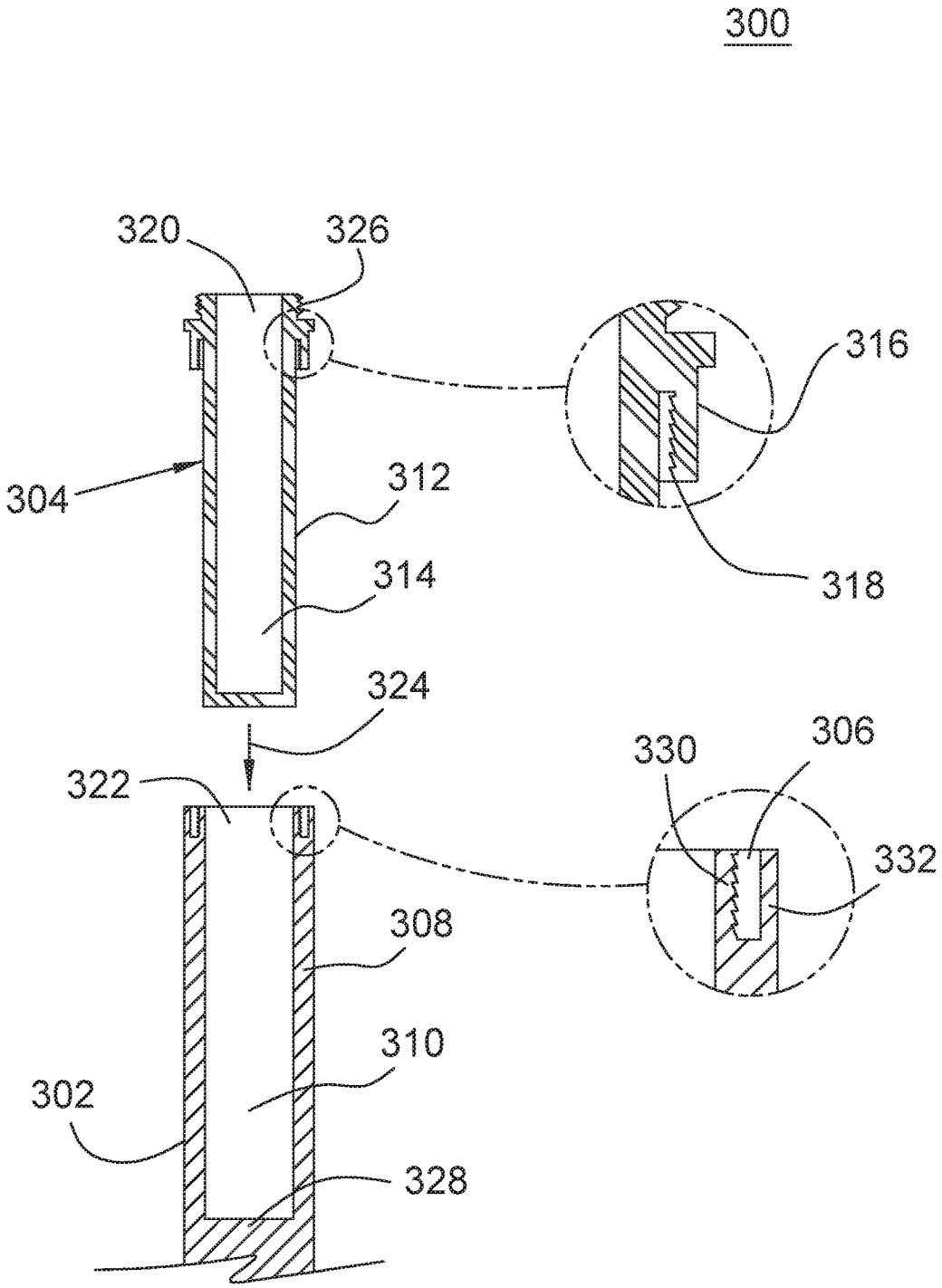
FIG. 3 shows a side cutaway view of a cosmetics container system, in accordance with some embodiments.

FIG. 3 shows a side cutaway view of a cosmetics container system 300, in accordance with some embodiments. A carrier 302 includes a cavity 310 in which a container 304 is received. The container 304 is placed into the cavity 310, defined by the walls 308 of the carrier 304 and optionally an internal wall 328. The cavity 310 is contiguous with an opening 322 and at end of the carrier 302, and the container 304 is inserted as indicated by arrow 324. The container 304 has an internal volume 314 in which material such as a cosmetic product can be disposed. The internal volume 314 is defined by sidewalls 312, and is contiguous with an opening 320.

To removably retain the container 304 in the carrier 302, the carrier 302 includes a threaded top collar portion 306 with threads 330. The container 304 includes a corresponding collar 316 having mating threads 318 that engage threads 330. Thus, container 304 is placed into the cavity 310 so that threads 318 meet threads 330, and then the container 304 can be turned to further engage threads 330, 318 with each other until the container is snugly secured (e.g. "finger tight"). The collar 316 can fit within a recess between the threads 330 and the outer collar 332 in some embodiments, and in some embodiments the outer collar 332 can be left out (i.e. not present). To retain the cap on container 304, cap threads 326 are provided to engage similar threads on a cap (not shown).

Figure 4:
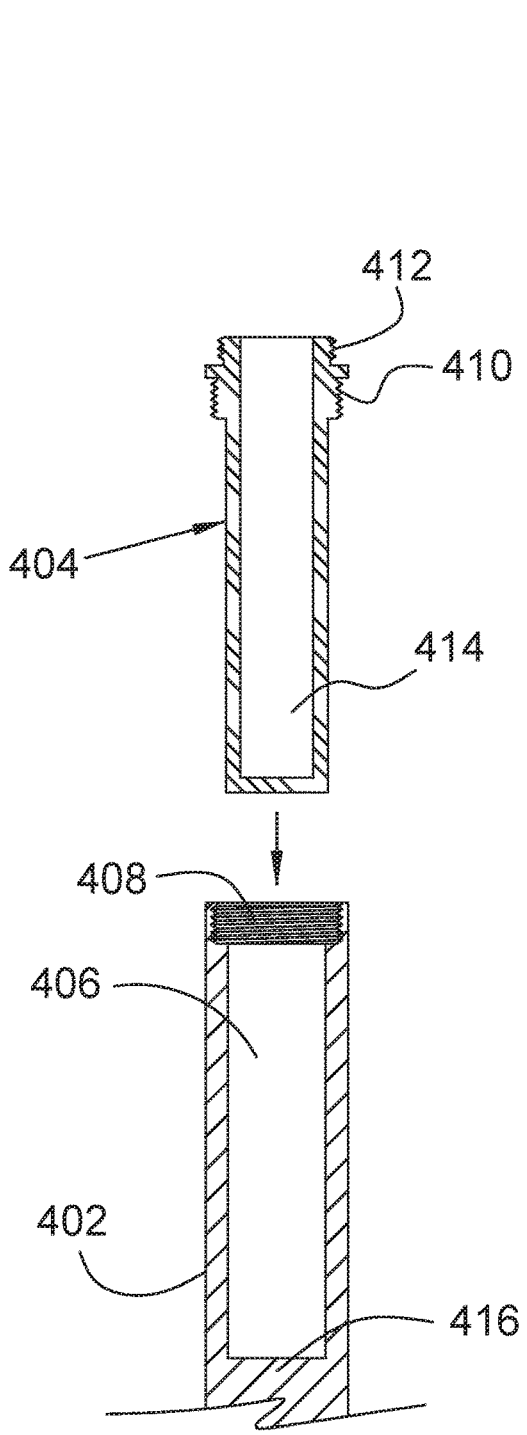
FIG. 4 shows a side cutaway view of a cosmetics container system, in accordance with some embodiments.

FIG. 4 shows a side cutaway view of a cosmetics container system 400, in accordance with some embodiments. A container 402 includes a cavity 406 within the carrier 402. An internal wall 416 may be present to define a bottom of the cavity 406. Threads 408 are formed at an open end of the carrier 402. A container 404 can be inserted into the cavity 406 such that a threaded portion 410 mates with threads 408. Again, the container 404 can be turned to engage threads 408 with those of 410. An internal volume 414 of container 404 can be accessed at an open end of the container 404, which can be secured by a cap that threads onto cap threads 412.

Figure 5:
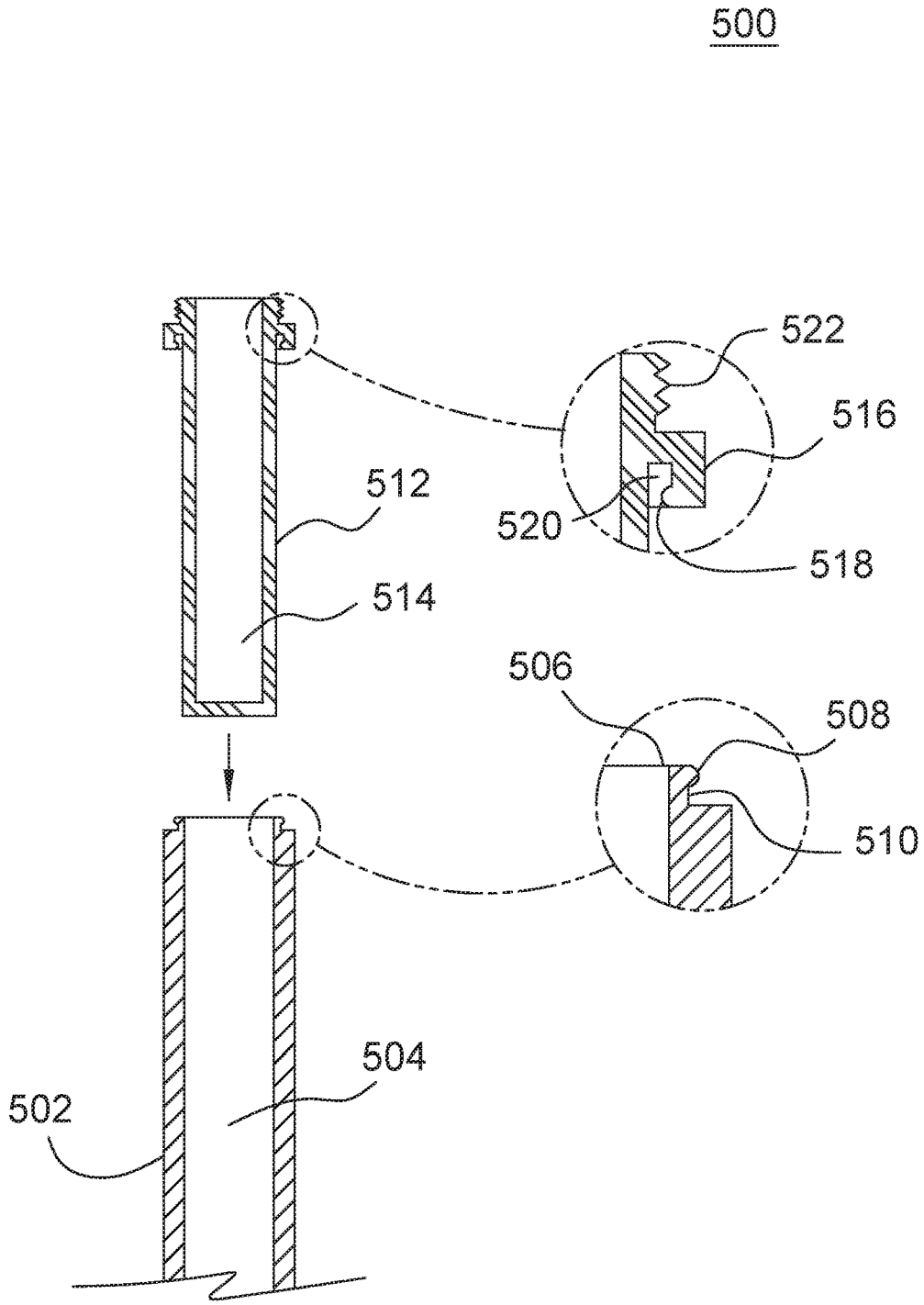
FIG. 5 shows a side cutaway view of a cosmetics container system, in accordance with some embodiments.
Figure 6:
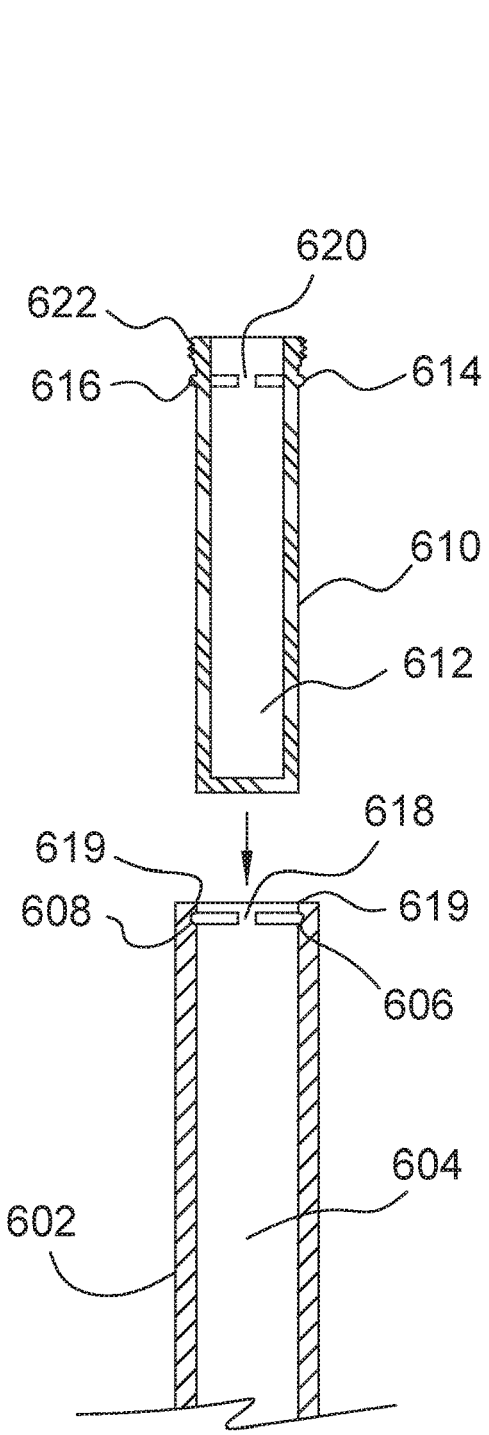
FIG. 6 shows a side cutaway view of a cosmetics container system, in accordance with some embodiments.

In general, embodiments such as those exemplified by systems 300 & 400 show that a container can be retained in a carrier by threaded engagement, and the container can further provide threads to engage and retain a cap to seal the container. FIGS. 5 and 6 show examples of embodiments where the containers are retained by mechanical interference.

FIG. 5 shows a side cutaway view of a cosmetics container system 500, in accordance with some embodiments. A carrier 502 includes a cavity or hollow portion 504 bounded by sidewalls of the carrier 502. The cavity extends out to an opening 506 at an end of the carrier 502, into which a container 512 can be inserted. An interference ridge 508 is formed around the circumference, or most of the circumference, of the end of the carrier 502, around the opening 506, or near the opening. Below the interference ridge 508 is a relief 510. The container 512 includes a collar 516 that extends around, or mostly around, the circumference of the container 512 near the top of the container 512. the collar 516 includes an interference ridge 518 and a relief 520 above the interference ridge 518. The interference ridge 518 faces inward, and interference ridge 508 on the container 502 faces outward. When the container 512 is inserted into the cavity 504 of the carrier 502, interference ridge 518 meets interference ridge 508 as they are sized and located to interfere with each other. The collar 516 is made of a plastically deformable material that allow it to be deflected outward so that interference ridge 518 can move past interference ridge 508 into relief 510, and likewise interference ridge 508 will then be located in relief 520, thereby retaining the container 512 in the carrier 502. The container 512 can include cap threads 522 to receive a cap which can be used to push the container 512 into the carrier 502, as well as to pull the container 512 out of the carrier 502. To prevent the container 512 from spinning inside the carrier 502 when the cap is screwed on or off the container 512, the interference ridge 518 and 508 can extend only partially around the container and carrier, with stop portions on each of the container 512 and carrier 502 that mate and prevent turning of the container 512 in the carrier 502.

FIG. 6 shows a side cutaway view of a cosmetics container system 600, in accordance with some embodiments. Embodiments in accordance with the example of FIG. 6, like FIG. 5, use interference to retain a container in a carrier. Accordingly, carrier 602 includes a cavity or space 604 in which a container 610 is received and retained. The carrier includes circumferential relief slots 606, 608 which extend into the wall of the carrier 602. The relief slots 606, 608 can be separated by stop gaps 618 that are simply portions of the wall of the carrier 602.

The container 610 includes an internal volume 612 in which a cosmetic or other product can be disposed. Near the top portion of the container 610, interference ridges 614, 616 are formed which protrude slightly from the outside of the container 610. As the container 610 is inserted into the cavity 604 of the carrier 602, the interference ridges meet the lip 619 of the container, and are deflected inward due to the plastic resilience of the material used to form the container 610. The container can then be further moved into the cavity 604 until the interference ridges 614, 616 enter into slots 606, 608, respectively. The outward force of the walls of the container 610, which have been deflected inwards as the ridges 614, 616 move downward past the lip 619, force the ridges 614, 616 into the slots 606, 608. A portion 620 of the outside of the container 610 lacks an ridge protrusion, and corresponds with stop gap 618, which acts to prevent the container 610 from turning in the cavity 604, such as when the cap is screwed on or off the container 610 on cap threads 622. The interference of the ridges 614, 616 against the inner wall of the carrier 602 while the ridge 614, 616 are in slots 606, 608 retains the container 610 in the cavity 604. However, a sufficient force can again overcome the interference, by pulling the container out of the carrier 602, to remove the container 610 from the carrier 602.

Figure 7:
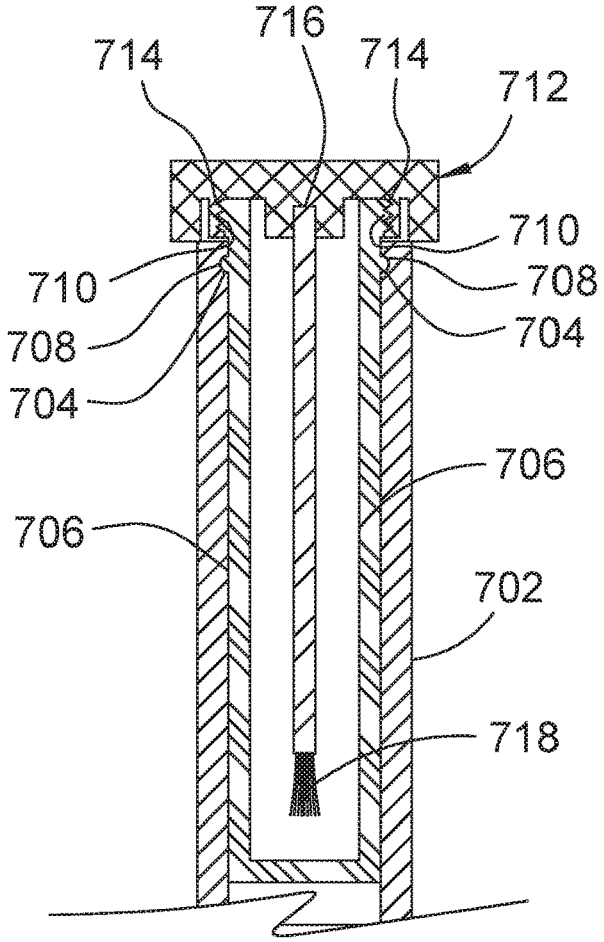
FIG. 7 shows a side cutaway view of a cosmetics container system, in accordance with some embodiments.

FIG. 7 shows a side cutaway view of a cosmetics container system 700, in accordance with some embodiments. The system 700 uses a similar embodiment to that exemplified in FIG. 6 to further show inclusion of the cap with an applicator. Accordingly, a carrier 702 has a cavity in which a container is disposed. The container is defined by a wall 706. The carrier 702 has ridges 704 formed in the inner wall of the carrier. The cavity in the carrier 702 is sized to snugly receive the outer dimension of the container wall 706 in close proximity. Ridges 708 on the outside of the container wall 706 mate with, and protrude into the slots 704 to form an interference retention of the container in the carrier 702. The container further includes cap threads 710 which mate and engage with corresponding threads 714 of a cap 712 to allow the cap 712 to be screwed on and off the container to seal the container and allow access to the contents of the container. The cap 712 can include a applicator comprised of a stem 716 and a brush 718 at the distal end of the stem 716. Other types of applicators besides brushes can be used equivalently.

To insert a container into the carrier 702, the bottom of the container, which is opposite the cap, is inserted into the carrier 702, and moved further into the carrier until the ridge 708 meets the lip of the carrier 702. A slightly greater force is then used to deflect the ridges 708 inward so that the container can be moved further into to carrier 702 until the ridge 708 mates with the slot 704. Likewise, a person can grip the cap 712 to pull the container out of the carrier 702 by exerting enough force to overcome the interference of the ridge 708 with the inner wall of the carrier 702.

Accordingly, there are a variety of ways in which a disposable container or cartridge can be removably retained in a carrier. In some embodiments the container can include threads that mate with corresponding threads in the carrier. In some embodiments the container can be retained by interference. Other features to retain the container so that it can be used, and then removed by a user, will be contemplated by those skilled in the art which operate equivalently to the several examples described here. The system thereby allows a user to select which containers, and therefore which cosmetic products, are carried in the carrier, at any given time. The user can switch out containers for other container to carry different shades or different types of cosmetics, or to replace empty containers. It is contemplated that, in some embodiments, the containers can have an internal volume of about 0.24 ounces.

Figure 8:
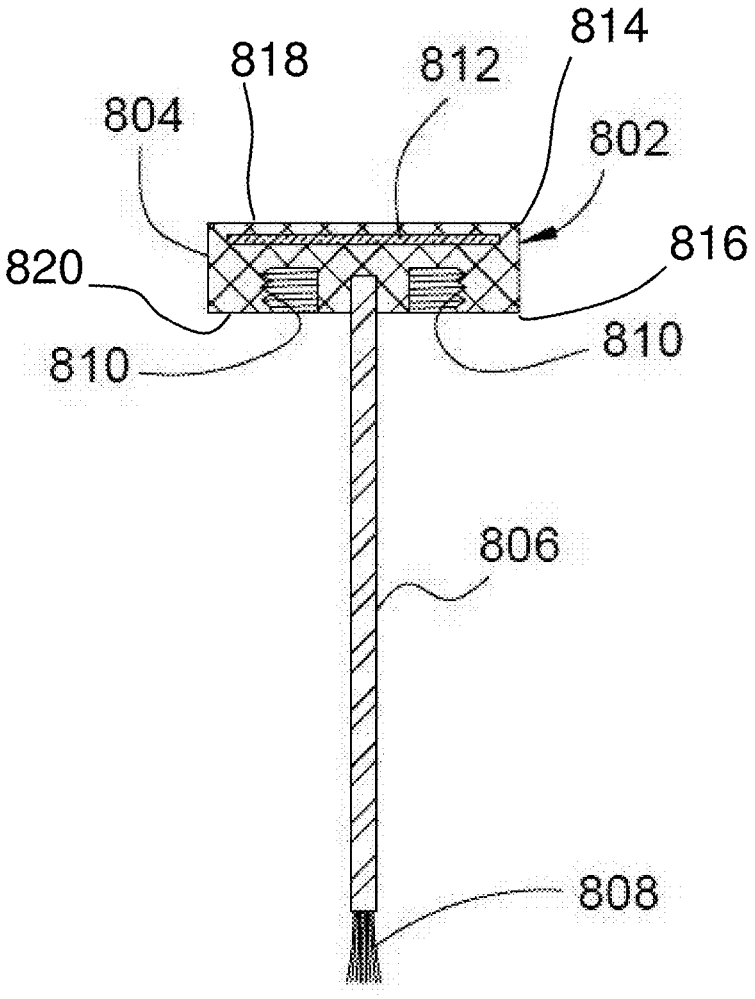
FIG. 8 shows a side cutaway view of a cap including a brush cosmetics applicator, in accordance with some embodiments.

FIG. 8 shows a side cutaway view of a cap 800 including a brush cosmetics applicator, in accordance with some embodiments. The cap 800 includes a top 802 which is gripped and held by a user. The top can be made of a plastic material that is molded to the desired shape. The top has an outer surface 818 that is flat at an upper edge 814 of the top 802 across the top 802. A side 804 of the top 802 extends from the upper edge 814 to a lower edge 816 which meets a lower surface 820 that is opposite the outermost surface 818. On the side 804 of the top 802 there can be friction features such as knurling to enhance a user's grip. The cap 800 includes a stem 806 which extends form the lower surface 820 and can have a brush 808 or other structure for carrying cosmetics material or other material that may be disposed in the container to be applied. To retain the cap 800 on a container, the top 802 can further include threads 810 at the lower surface 820 that mate with corresponding threads of a container. Since the cap 802 is intended, in some embodiments, to act as a base, the top 802 can include a weight 812 in the top 802 to help keep the carrier from tipping over when being used as shown in FIG. 2, for example. The weight 812 can be a metal component, such as mild steel. Furthermore, to facilitate using the caps as a base, the outermost surface 818 of each of the caps each extends, in a direction perpendicular to the axis of the container, around the entirety of the upper edge 814, beyond an outside wall of the carrier when the cap is threaded onto its respective container.

Figure 9A:
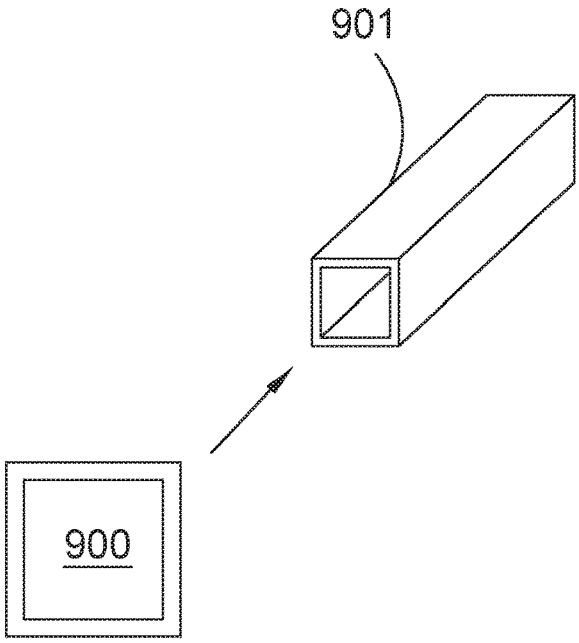
FIGS. 9A and 9B show cross section view of a carrier for a cosmetics container system where the carrier has a non-circular cross section, in accordance with some embodiments.
Figure 9B:
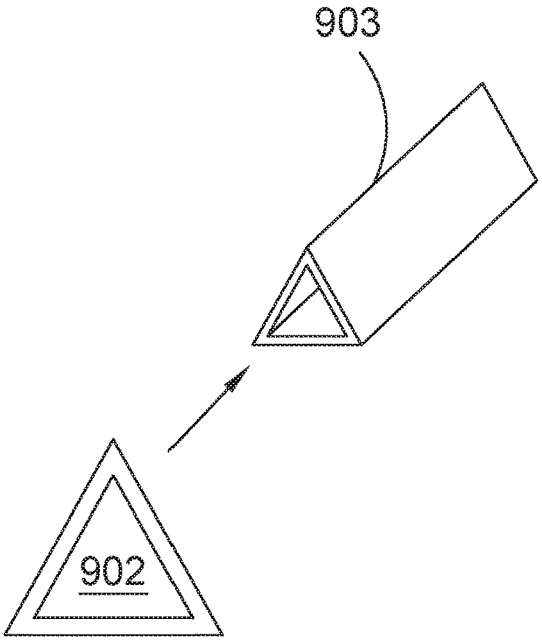

FIGS. 9A and 9B show cross section views of carriers for a cosmetics container systems where the carriers have a non-circular cross section, in accordance with some embodiments. In FIG. 9A, the carrier has a rectangular or square cross section 900, forming a corresponding carrier 901. In FIG. 9B the carrier has a triangular cross section 902, forming a corresponding carrier 903. Numerous other shapes will occur to those skilled in the art. One function of a non-circular cross section as shown is that containers, which have a corresponding exterior shape to match the interior shape of the non-circular carrier, will not spin within the carrier when the cap is screw on or off the container.

Accordingly the disclosed packaging and carry container system provides the benefit of allowing a user to change and/or replace containers of product in a small, carry system suitable for products such as cosmetics. A user can, for example, insert a container for lip gloss and a container for nail polish that color match, and carry the system for touchups throughout the day. The system is intended to be small, with the volumes of the containers being on the order of one quarter of an ounce, and the system having a length on the order of three inches or less and a diameter of the carrier of about half an inch or less. By making the external portion of the system a permanently kept item, the containers that fit within the carrier can be made of more disposable materials without inks or dyes. Compared to conventional cosmetics packaging systems, the disclosed system can greatly reduce the amount of waste resulting from cosmetics sales and marketing. For example, nail polish is typically sold in small glass bottles, and include a cap with an applicator. In the disclosed system the waste is lighter, more recyclable, and requires less volume to ship a given quantity of product over conventional packaging while still allowing the user to have decorative and attractive carriers.

What is claimed is:

1. A cosmetics packaging and carry container system, comprising:

a carrier comprised of an elongated body having a first end and a second end, the first and second ends at opposing terminal ends of the elongated body and defining an axis of the carrier, the carrier further having a first cavity formed at the first end that extends into the elongated body on the axis of the carrier, and a second cavity formed at the second end that extends into the elongated body on the axis of the carrier;

a first collar portion at the first end of the carrier in which a recess is formed that is open at the first end and which is between an outer collar and a threads;

a second collar portion at the second end of the carrier in which a recess is formed that is open at the second end and which is between an outer collar and a threads;

a first container having a body portion that defines an internal volume and that is sized to fit within the first cavity, and including a threaded collar configured to fit into the recess of the first collar portion between the threads and the outer collar of the first collar portion and engage the threads in the recess of the first collar portion to removably retain the first container in the first cavity, the first container further including a first cap configured to close the internal volume and including an applicator attached to the first cap that extends into the internal volume;

a second container having a body portion that defines an internal volume and that is sized to fit within the second cavity, and including a threaded collar configured to fit into the recess of the second collar portion between the threads and the outer collar of the second collar portion and engage the threads in the recess of the second collar portion to removably retain the second container in the second cavity, the second container further including a second cap configured to close the internal volume and including an applicator attached to the second cap that extends into the internal volume;

wherein the first cap and the second cap each have a top that has an upper edge and an outermost surface at the upper edge across the top that is flat in a plane that, when the first and second cap are on the first and second containers to close the internal volume of the first and second containers respectively, is perpendicular to the axis of the carrier, and wherein the outermost surface of each of the first and second caps extends, around an entirety of the upper edge of each of the first and second caps, in a direction perpendicular to the axis of the container, beyond an outside wall of the carrier; and the top of the first cap includes a metal weight component.

2. The cosmetics packaging and carry container system of claim 1, wherein the outermost surfaces of the caps of the first and second containers each measure one inch across.

3. The cosmetics packaging and carry container system of claim 1, wherein the top of the second cap further includes a metal weight component.

4. The cosmetics packaging and carry container system of claim 1, wherein the internal volume of the first container and the internal volume of the second container are each limited to 0.24 ounces.

5. The cosmetics packaging and carry container system of claim 1, wherein the carrier has a non-circular cross section.

6. The cosmetics packaging and carry container system of claim 1, wherein the outermost surface of the first and second caps is non-circular.

* * * * *